United States Patent [19]

Leone et al.

[11] Patent Number: 4,926,016

[45] Date of Patent: May 15, 1990

[54] MOVING CONTACT BLADE BARRIER

[75] Inventors: David A. Leone; Clifford A. Buxton, both of Lawrenceville; Don Quinton, Stone Mountain, all of Ga.

[73] Assignee: Siemens Energy & Automation, Inc., Atlanta, Ga.

[21] Appl. No.: 242,092

[22] Filed: Sep. 8, 1988

[51] Int. Cl.[5] ..... H01H 33/04; H01H 33/12

[52] U.S. Cl. ..... 200/144 R; 200/146 R

[58] Field of Search ..... 200/146 R, 144 R

[56] References Cited

U.S. PATENT DOCUMENTS 3,560,683 2/1971 Maier ..... 200/146 R 4,716,265 12/1987 Fujii et al. ..... 200/144 R

*Primary Examiner*—Robert S. Macon

*Attorney, Agent, or Firm*—James G. Morrow; Lawrence C. Edelman

[57] ABSTRACT

A single piece contact barrier for separating and maintaining the spacing of the contact blades in a circuit breaker. The barrier is also adapted to form an insulating barrier between the contact blades and produce an arc quenching vapor. Under certain circumstances, when one contact and its associated contact are separated, an arc is formed between the contacts. The heat generated by the arc causes the barrier to vaporize in near the arc such that the vapor tends to quench the arc.

8 Claims, 3 Drawing Sheets

MOVING CONTACT BLADE BARRIER

BACKGROUND OF INVENTION

This invention relates to a main contact blade assembly for a switching device, and more particularly, to an apparatus for spacing and separating a plurality of circuit breaker contact blades.

When the current carrying contacts of a circuit interrupting device are separated while a current is flowing through the contacts, an arc is normally formed between the contacts. Depending on the intensity and duration of the arc, the contact material and materials surrounding the arc experience varying degrees of deterioration. For example, the contact surfaces can be eroded such that the contact interface has an increased resistance which causes localized heating and further deterioration of the contacts. In dealing with this problem, it is desirable to either extinguish the arc in the least amount of time possible and/or move the arc from between the contacts to a location where the damage done by the arc does not severely affect the operation of the circuit interrupting device.

Additionally, it is important to keep the contact carrying blades of a circuit breaker separated and consistently spaced while also insulating the individual contact blades. One way of insulating the individual contact blades is to coat each blade with an insulating material. During the opening of an electrical device under fault conditions, various electromagnetic forces act on the components of a circuit breaker. In particular, the parallel current paths in the contact blades tend to produce electromagnetic forces which urge the contact blades together. One method for preventing the contact blades from being urged together is to insert individual spacers between the contact blades.

Accordingly, it is important to provide means for separating the contact blades. Additionally, it is important to provide means for extinguishing and/or moving an arc to a location where damage done by the arc is not critical.

SUMMARY OF THE INVENTION

An object of the present invention is to provide a means for maintaining the separation of a plurality of contact blades for a circuit interrupting device. Another object of the present invention is to provide a means for moving and extinguishing an arc at the primary contacts of a circuit interrupting device.

Accordingly, there is provided an insulating apparatus for spacing a plurality of contact blades. The apparatus includes means for spacing the contact blades and means for shielding the bottom surfaces of the contact blades from an arc.

An advantage of the present invention is that it provides an integral assembly for separating and insulating all of the contact blades for one phase of a circuit breaker. Using an integral assembly for this purpose reduces assembly costs by eliminating the need for individually inserting spacers between the contact blades. Another advantage of the present invention is that it provides an insulating means which prevents an arc from moving along the bottom portion of a contact blade. Another advantage of the present invention is that it can assist in uniformly lifting the contact blades. Still another advantage of the present invention is that a portion of it can be vaporized by the heat of an arc to produce a gas in close proximity to an arc for moving and extinguishing the arc.

Various other objects and advantages of the present invention will become apparent from the following description, with reference to the accompanying drawing.

DETAILED DESCRIPTION OF THE PREFERRED EMBODIMENT

Figure 1:
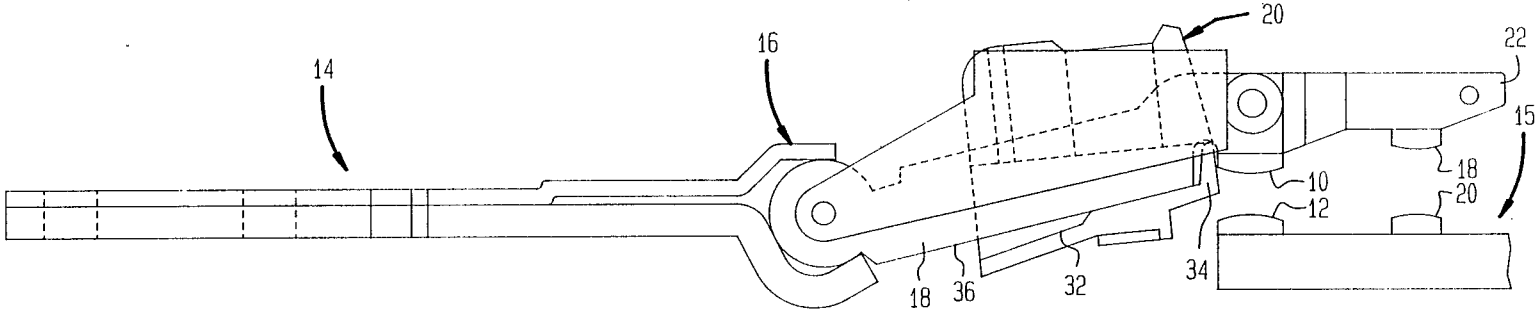
FIG. 1 is a side view of the current carrying contact blade assembly in combination with a moving contact blade barrier.

Referring to the drawings, FIG. 1 illustrates a current path for a circuit breaker such as a molded case circuit breaker. The opening and closing of this path is achieved by separating and engaging the contacts 10, 12. To carry a given current, a plurality of contacts 10 are normally provided to each carry a portion of the total load current. The current path from the terminal 14 includes a pivoting connection 16 which cooperates with movable contact blades 18 to provide a current path which allows the contacts 10, 12 to be opened and closed. For each contact 10 there is an associated blade 18.

Figure 2:
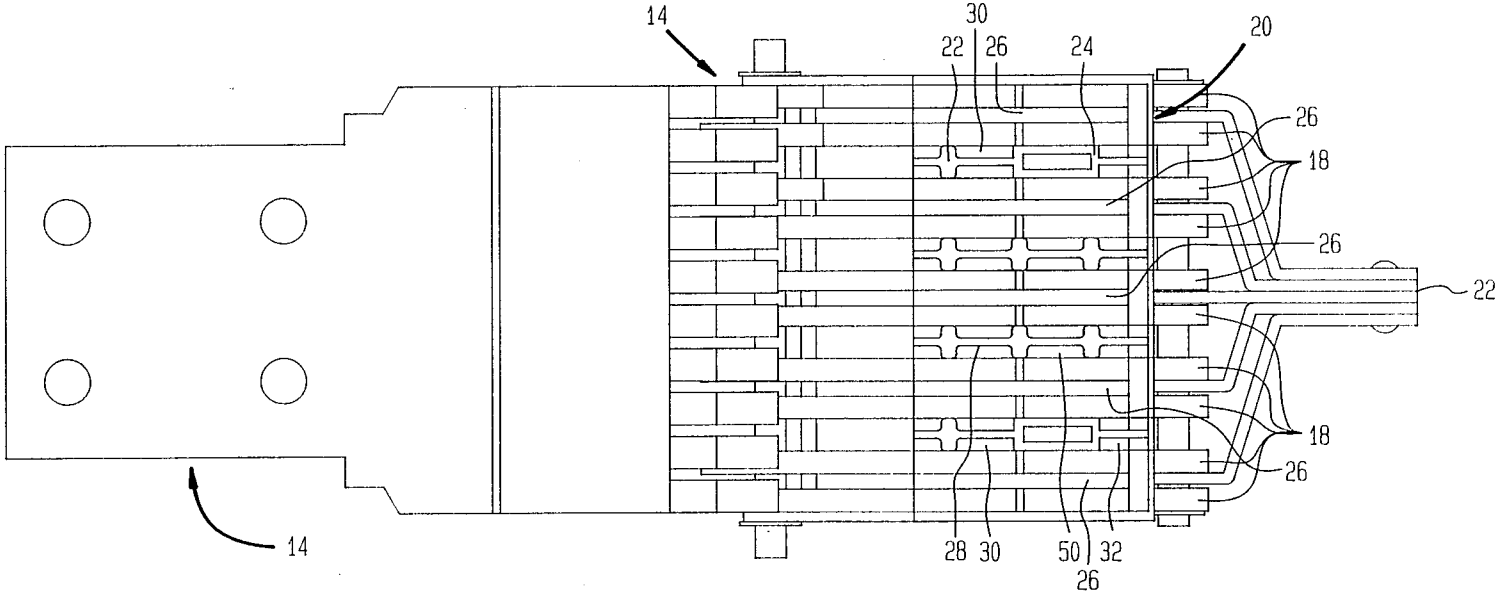
FIG. 2 is a top view of the current carrying contact blade assembly in combination with the moving contact blade barrier.
Figure 3:
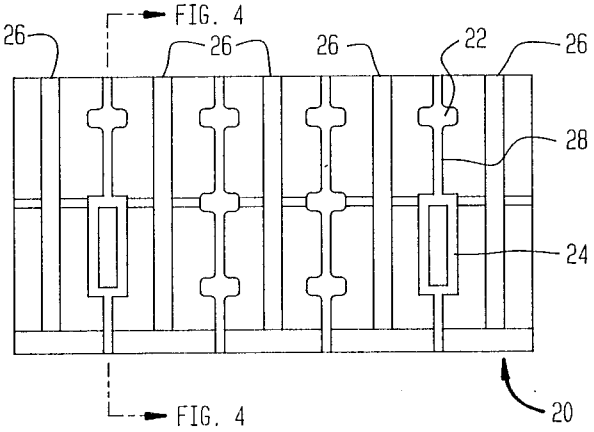
FIG. 3 is a top view of the contact blade barrier.

Referring to FIGS. 2 and 3 the plurality (e.g., 10) of contact blades 18 are separated by a moving contact blade barrier 20. The barrier 20 is a molded element which includes a plurality of spacers 22, engagement receptacles 24 and separating walls 26 for spacing the contact blades 18. The engagement receptacles 24 also provide a location to attach an apparatus, for pivoting the blades 18, to the barrier 20. By attaching the apparatus, for pivoting the blades 18, to the barrier 20, the blades 18 are uniformly pivoted, and thus the contacts 10, 12 are opened simultaneously.

In addition to providing a means for separating the blades 18, the spacers 22 and engagement receptacles 24 cooperate with partitions 28 to form air gaps 30 between the blades 18. The air gaps 30 assist in insulating the blades 18 from each other both electrically and thermally. The air gaps 30 also provide a means for allowing air to circulate along the sides of the blades 18 to allow cooling of the blades 18.

Figure 4:
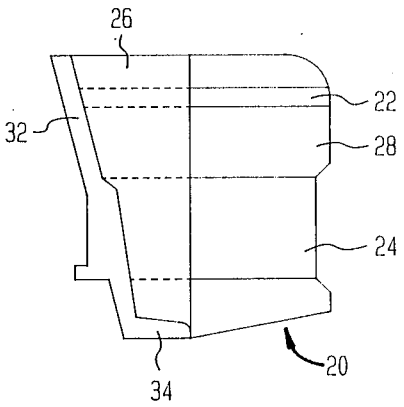
FIG. 4 is a side view of the contact blade barrier.

FIGS. 1 and 4 are side views of the barrier 20 and illustrate the insulator portion 32 and vapor generating portion 34 of the barrier 20. The insulator portion 32 supports the blades 18 so that they can be uniformly pivoted. Additionally, the insulator portion 32 insulates the bottom edge 36 of the blades 18 so that an arc occurring between the contacts 10, 12 will be prevented from propagating along the bottom edge 36 of the blades 18. The vapor generating portion 34 also prohibits an arc from propagating along the bottom edge of the blades 18. In addition, the vapor generating portion 34 provides an arc extinguishing vapor in close proximity to the arc when the portion 34 is heated by an arc.

By way of example, the barrier 20 can be fabricated from a high temperature high dielectric arc quenching material. This type of material is adequate to provide the strength required for the barrier 20 and also provides an arc quenching vapor when it is heated by the arc.

While one embodiment of a moving contact blade barrier has been shown and described in detail herein, various other changes and modifications may be made without departing from the scope of the present invention. For example, the barrier could be adapted to work with varying numbers of contact blades. Additionally, the engagement receptacles could be made to have a different configuration depending on the type of apparatus used to pivot the blades. Also, the air gaps could be configured in a manner such that cooling is optimized for a given blade configuration. For example, by passing the air gaps 30 through the insulator portions 32.

We claim:

1. An insulating apparatus for spacing a plurality of contact blades, wherein the contact blades each define a bottom surface, comprising:

means for spacing the contact blades; and means for shielding the bottom surfaces of the contact blades from an arc.

2. The apparatus of claim 1 wherein the means for spacing the contact blades comprises a plurality of spacers.

3. The apparatus of claim 2 wherein the means for spacing the contact blades further comprises a plurality of partitions.

4. The apparatus of claim 3 wherein the means for spacing the contact blades further comprises at least one engagement receptacle.

5. The apparatus of claim 4 further comprising a means for producing an arc quenching vapor when heated by an arc.

6. A contact blade barrier for spacing and supporting a plurality of circuit breaker contact blades, wherein the contact blades each define a bottom surface and a contact means, comprising:

means for spacing the contact blades; and a member for shielding the bottom surfaces of the contact blades from an electrical arc.

7. The barrier of claim 6 wherein the member comprises:

a first portion for shielding the bottom surfaces of the contact blades; and a second member for shielding a portion of each contact blade and producing an arc quenching vapor in the proximity of the contact means when heated by an arc.

8. The barrier of claim 7 wherein the means for spacing the contact blades includes at least two spacers, wherein the spacers and two blades cooperate to form at least one air gap adjacent to the blades.

* * * * *